United States Patent [19]

Tom et al.

[11] 3,997,811

[45] Dec. 14, 1976

[54] COLOR TELEVISION TUBE STRUCTURE AND METHOD OF MANUFACTURE

[75] Inventors: Elgin Megginson Tom, Toledo; Roland L. Vogelpohl, Gahanna, both of Ohio

[73] Assignee: Owens-Illinois, Inc., Toledo, Ohio

[22] Filed: July 9, 1975

[21] Appl. No.: 594,531

[52] U.S. Cl. ..... 313/404; 220/2.1 A; 313/482

[51] Int. Cl.[2] ..... H01J 29/07; H01J 31/20

[58] Field of Search ..... 313/404, 406, 407, 408, 313/405, 477, 482

[56] References Cited

UNITED STATES PATENTS

| | | | |
|---|---|---|---|
| 3,890,526 | 6/1975 | Palac | 313/404 X |
| 3,904,914 | 9/1975 | Palac | 313/407 X |
| 3,912,963 | 10/1975 | Sedivy | 313/408 X |

*Primary Examiner*—Robert Segal
*Attorney, Agent, or Firm*—S. M. McLary; E. J. Holler; R. B. Dence

[57] ABSTRACT

A rimless faceplate is mounted on a shadow mask color selection device for a color television tube construction by indexing means establishing a unique positional relationship between the faceplate and the mask. An array of cavities on the inner surface of the plate interfit with the studs on mask mounting brackets to provide transverse positioning while the bracket surfaces extending outward from the studs provide abutting surfaces to the inner face of the faceplate adjacent its stud receiving cavities to establish faceplate-mask spacing. A glass funnel receives the mask in its divergent end with precise spacing of the mask from its seal edge. Portions of the mask mounting brackets are fitted into seats in the funnel which may be cavities or depressions in the seal edge to establish the spacing, particularly the depth of entry of the mask in the funnel. When the seated bracket portions also support the faceplate indexing studs and are seated in the seal edge of the funnel, a precisely related rugged construction results by sealing those bracket portions in the faceplate-funnel seal. Transverse and circumferential indexing of the mask in the funnel is enhanced by providing integral indexing or reference surfaces on the inner walls of the funnel. Radially outward biasing means on a rigid mask frame are abutted against the internal reference surfaces for transverse orientation of the mask and thus the faceplate. Interfitting protuberances and cavities for the biasing means and reference surfaces, as slots in bosses on the funnel inner surface engaged by studs on the biasing means, provide circumferential orientation of the mask and thus the faceplate on the funnel.

24 Claims, 20 Drawing Figures

COLOR TELEVISION TUBE STRUCTURE AND METHOD OF MANUFACTURE

BACKGROUND OF THE INVENTION

1. FIELD OF THE INVENTION

This invention relates to color television picture tube structures and to methods of manufacturing such structures.

2. DESCRIPTION OF THE PRIOR ART

Color television picture tubes comprise a viewing face or panel having a three color mosaic phosphor screen or image viewing portion of the faceplate, a color selection device in the form of a shadow mask having an apertured pattern aligned with the phosphor areas of the selected colors and with three electron guns for protecting separate electron beams through the mask at characteristic angles to activate the respective color phosphors on the screen. Color selection is achieved by selectively controlling the intensities of the electron beams. The spacing and alignment of the mask with respect to the gun and the mosaic phosphor screen must be established with precision and maintained throughout the fabrication and life of the tube. Slight rotational or longitudinal misalignment of the mask, screen and guns will result in degradation of the images developed and their color fidelity.

Heretofore color picture tubes have been manufactured in sections which are sealed together following necessary internal processing and subassembly. These sections include a viewing faceplate comprising a screen portion of substantially spherical curvature and an integral rim portion or skirt extending generally normal from the screen portion toward a funnel section and a neck of that funnel in which the electron gun assembly is mounted. Prior to assembly of the faceplate and funnel, the mosaic phosphor is formed on the internal surface of the screen portion and the color mask is mounted by fastening it to the rim portion. The rim portion is then sealed to the funnel and the electron gun assembly is mounted in the neck of the funnel. The tube is then sealed, evacuated and gettered.

In order to obtain the degree of precision in alignment of the mask and screen assemble, the customary practice has been to form the screen by photographic processes by exposure of photo-sensitive resists including the several phosphors through the mask. The phosphors for the three colors are applied in sequence by applying a coating to the inner face of the viewing screen, precisely mounting the mask, exposing the screen to light through a mask from a point corresponding to the position in the final assembled tube of the electron gun for the subject color, fixing the pattern of phosphors for that color and removing the unfixed phosphor containing material from the inner face of the viewing screen. The photographic process is repeated for each color component of the phosphor screen, and therefore, the mask is removed and remounted a number of times during the screen forming process. It is essential that the mask be positioned with respect to the faceplate in the same position for each photographic process and in the final assembly of the tube. Therefore the mounting arrangement for the mask must be sufficiently rigid and precise to define a unique mask position with respect to the screen. Further, the relationship of the screen and mask subassembly as mounted on the funnel to the electron guns in the neck of the funnel must also be established as a unique position axially, longitudinally and in a planar to axial or tilt relationship.

The manufacturing steps and apparatus involved in the production of color picture tubes require precision in the manufacture of the screen assembly, funnel, seal edges between the screen assembly and funnel, and the funnel neck. Variation is the surface of the glass of the viewing screen can result in unacceptable distortion. Thus rejection losses are high even in the initial glass forming of the parts. The addition of mounting elements for the mask to the rim of the screen assembly is highly critical and subject to production losses. The separable screen assembly and mask must be jigged with precision relative to the lighthouse, the light source for photographically generating the phosphor mosaic, on each sequence for developing a pattern of phosphors for a color. The seal of the screen assembly and mounted mask to the funnel is subject to the misalignments either initially or it subject to distortion during the thermal cycling of the parts, both of which must be avoided or limited to a narrow range of dimensional tolerances.

In accordance with the above, an object of this invention is to improve the structure of color television picture tubes.

Another object is to improve the optical quality of the viewing screen of color television picture tubes.

A third object is to increase the precision of alignment of the phosphor mosaic, mask and lighthouse and electron guns for color television picture tubes.

A further object is to simplify the manufacture of color television picture tubes.

SUMMARY OF THE INVENTION

The present invention involves a color television picture tube construction employing a rimless viewing panel which is mounted on a mask assembly in precise spatial relationship therewith for forming of the phosphor mosaic and final assembly with the funnel. A glass funnel having those elements, where precise positioning is critical, referenced to surfaces from which the mask and thus the viewing panel are also referenced simplifies fabricating procedures and enhances precision in the assembled tube.

In one arrangement, a faceplate of substantially spherical curvature and generally rectangular in its perimeter form is provided with at least two, and preferably three, slots extending radially from the tube axis and spaced around the periphery on the inner face of the faceplate adjacent its seal edge. The slots are adapted to receive pins on mask mounting brackets which are of a width which closely fits the width of the slots such that a unique mask position is established by fitting pins into the slots secured to mounting brackets on the mask with a spacing to register the pins with the slots. Thus the faceplate is supported on the mask and its associated mounting brackets.

The funnel to be sealed to the faceplate is provided with reference surfaces in the form of seats for pin supporting platforms of the mask mounting brackets. These seats are referenced to the tube axis as are associated bosses formed on the inner walls of the funnel adjacent the seal edge of the funnel to be mated with the faceplate. The funnel bosses transversely and circumferentially orient the mask brackets and thus the mask and the faceplate with respect to the tube axis while the seats longitudinally orient the mask bracket platforms and thus the mask and faceplate. Advantageously the faceplate orientation places its seal edge in contact with a seal edge on the funnel.

The funnel neck and funnel seal edge are also indexed with reference to the tube axis to enable the convenient mounting and alignment of the electron guns in the neck in their proper orientation with respect to the tube axis and thus the panel-mask assembly. In one embodiment the funnel is formed into a subassembly by applying a tubular neck which ultimately is utilized as the electron gun assembly mounting in the finished tube. In one arrangement the neck is applied with its inner surface referenced to the funnel axis and thereafter operations requiring critical index surfacing is referenced from the neck interior in the region in which the gun assembly is mounted thereby employing the coincident tube and gun axis as a reference. The seal edges of the funnel may then be ground normal to radii from the tube axis at the neck to conform generally to the spherical surface of the faceplate margins. This axis also may be used to establish the mask bracket platform seats, and in jigging the funnel during the mounting of the electron guns.

The rimless faceplate offers a number of advantages in manufacture in that it can be formed from sheet glass by precision sagging or vacuum forming. Even it it is pressed, its inner surface can be lap ground to a true spherical contour thereby providing a more uniform Q spacing with the mask.

The sealing of the face panel to the funnel can be arranged to insure accurate final positioning of the panel and mask by providing camming surfaces on the bracket pins which are advanced into the plate slots to bring the plate into alignment as the solder glass frit liquifies at the seal interface and the faceplate settles onto the funnel seal edge.

The above and additional objects and features of this invention will be appreciated more fully from the following detailed description of preferred embodiments when read with reference to the accompanying drawings.

DESCRIPTION OF THE PREFERRED EMBODIMENTS

Figure 1:
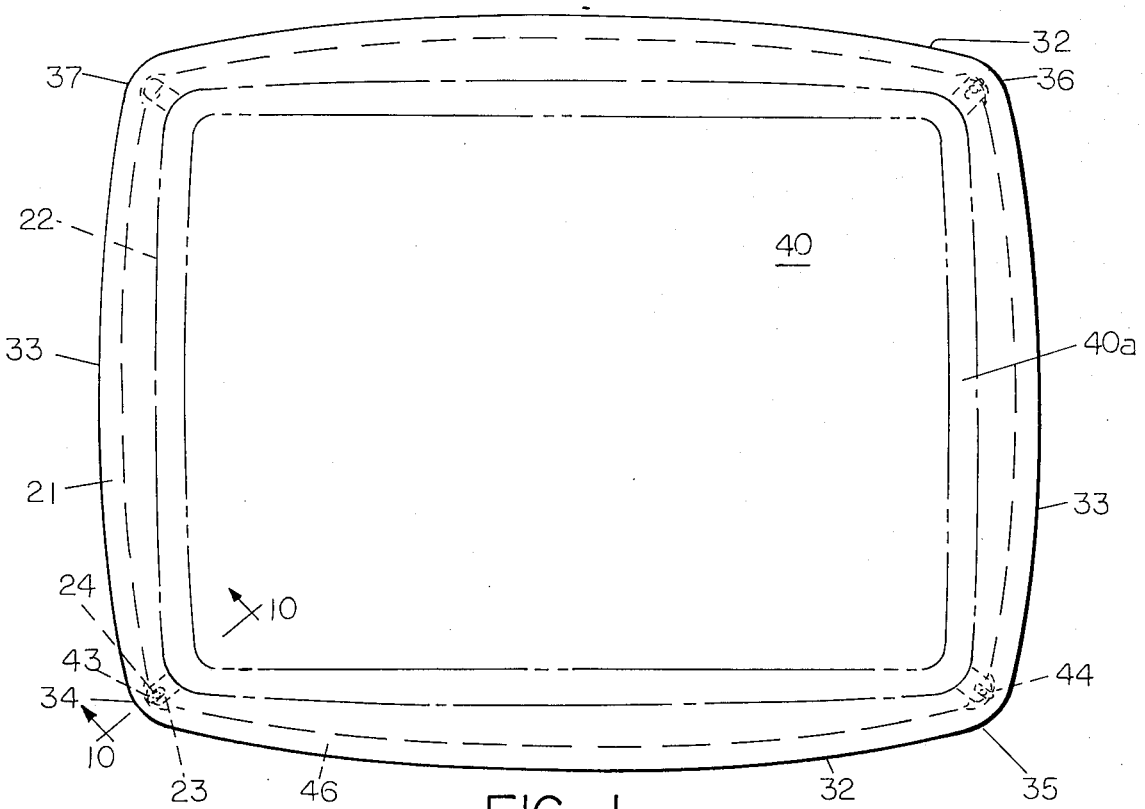
FIG. 1 is a front view of a rectangular color television picture tube according to this invention.
Figure 2:
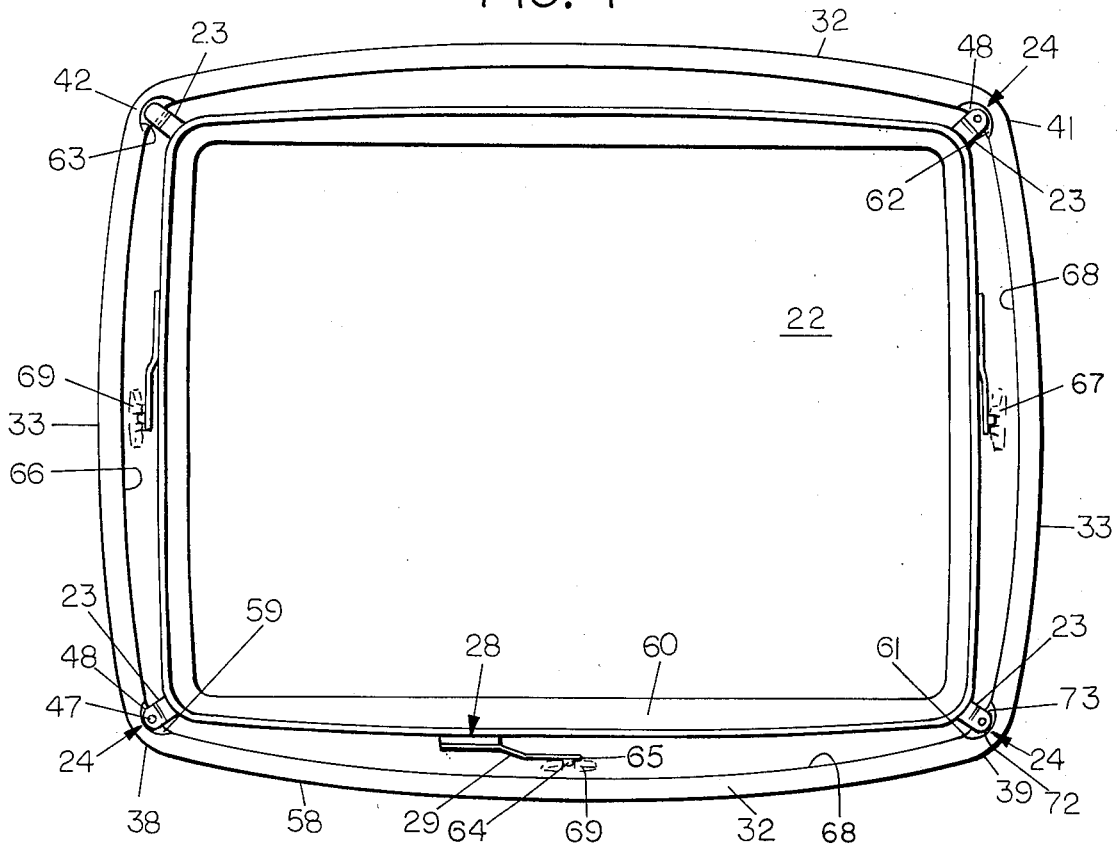
FIG. 2 is a view as in FIG. 1 with the faceplate removed to illustrate the indexing and mounting of a mask frame and the faceplate.
Figure 3:
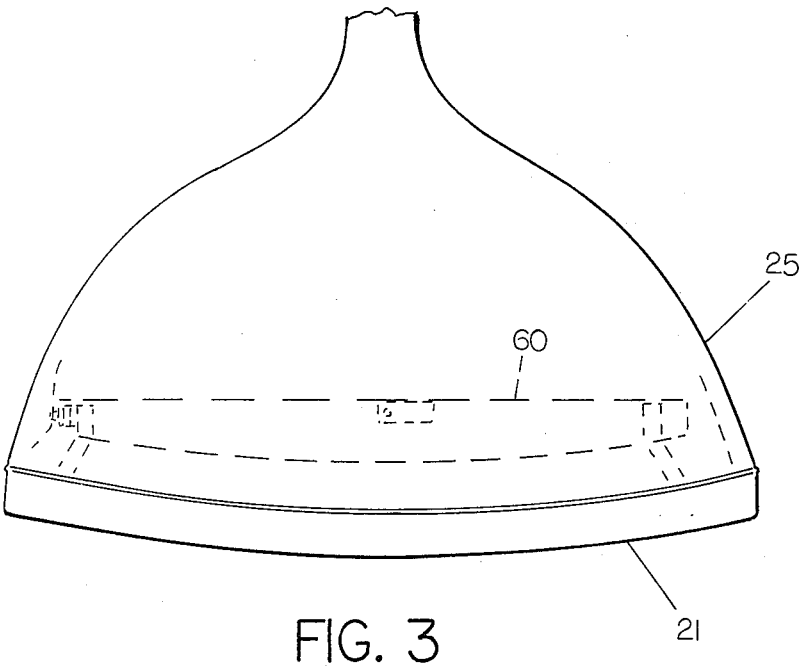
FIG. 3 is a side view of the tube envelope of FIG. 1 taken along the minor side of the tube.
Figure 4:
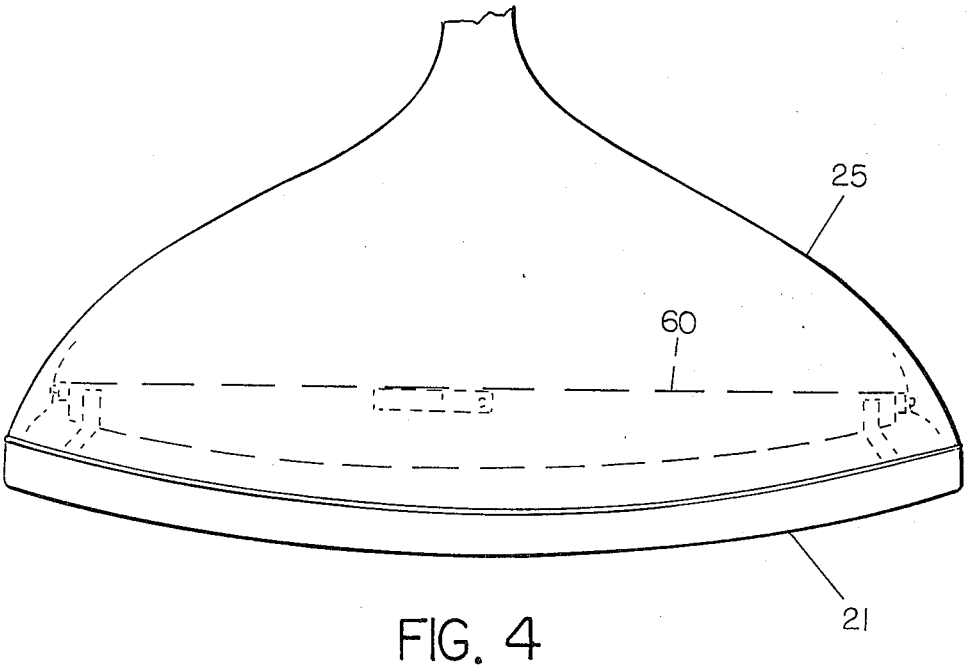
FIG. 4 is a side view of the tube envelope of FIG. 1 taken along the major side of the tube.
Figure 5:
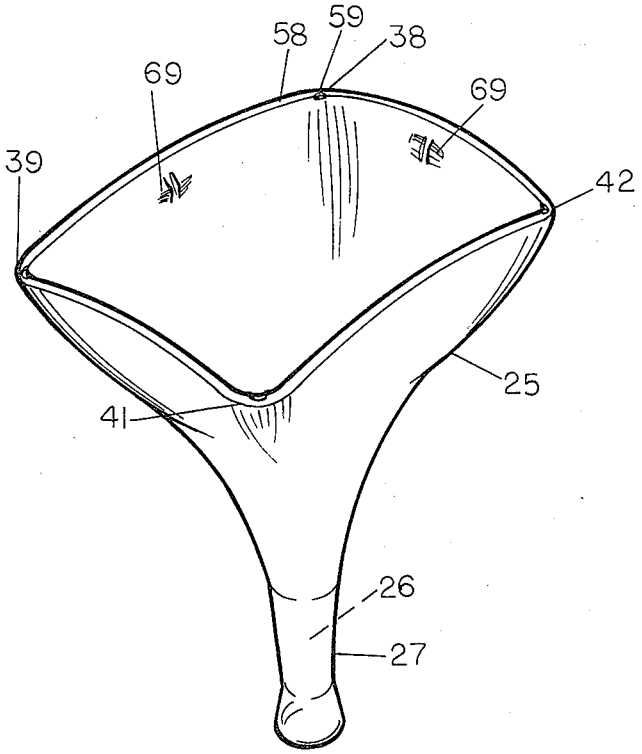
FIG. 5 is a perspective view of a funnel-neck subassembly according to this invention.
Figure 8:
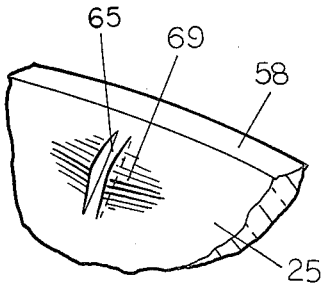
FIG. 8 is an enlarged fragmentary perspective view of a funnel at its seal edge and a boss for circumferential orientation of a mask.
Figure 9:
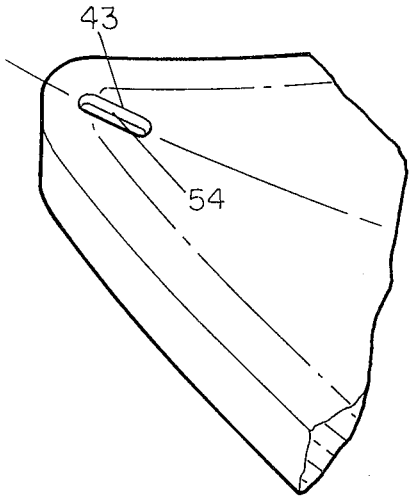
FIG. 9 is an enlarged fragmentary perspective of a corner of a face panel showing an indexing slot for the panel.

FIGS. 1, 3, 4 and 6 show the face panel 21 of a color television picture tube according to this invention mounted on a shadow mask 22 by means of mask support brackets 23 having indexing means 24 for precisely orienting, in a unique position, the panel 21 with respect to the mask 22. Mask support brackets 23 in turn are supported on a funnel 25 as shown in FIGS. 3, 4 and 5 to establish the longitudinal position and surface orientation along the tube axis of the mask and panel from a gun assembly mounting position 26 in the neck 27 of funnel 25. Circumferential and transverse orientation of the mask 22 and face panel 21 is referenced to the funnel 25 by means of brackets 28, shown in FIGS. 18 and 19, having outwardly biased spring arms 29 with indexing means 31 on the distal ends of arms 29 and the inner walls of funnel 25.

Figure 6:
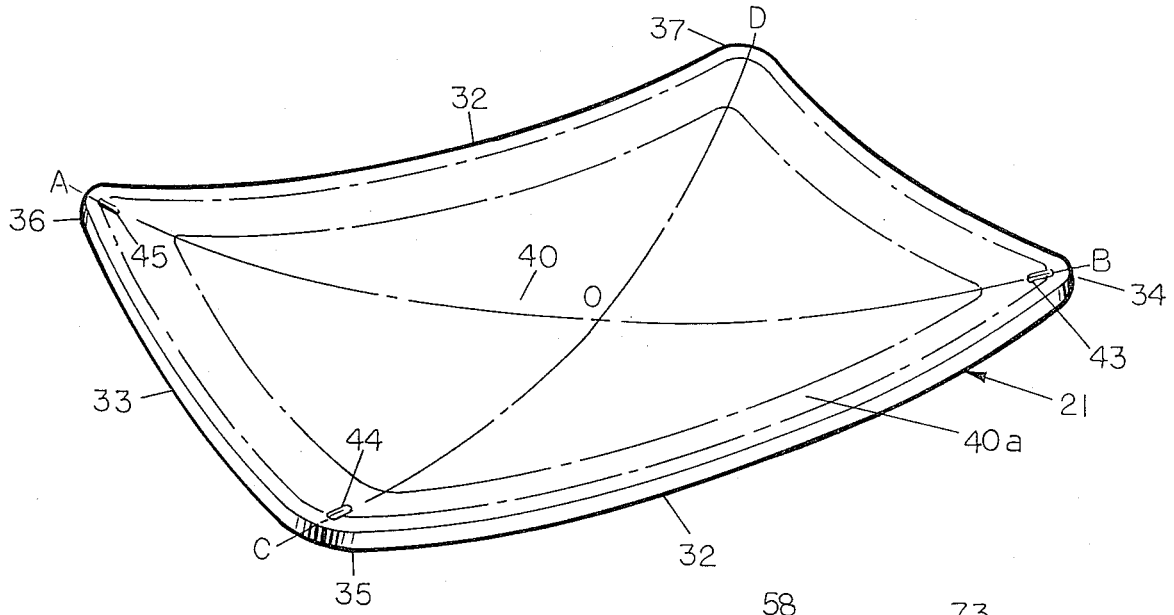
FIG. 6 is a perspective view of the interior of a face panel according to this invention.
Figure 7:
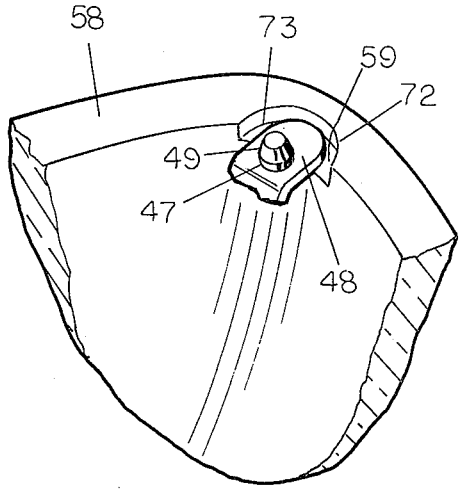
FIG. 7 is an enlarged fragmentary perspective view of a corner of a funnel at its seal edge showing a seat for the ear of a mask mounting bracket.

Face panel 21, as shown in FIG. 6, has a spherical surface and is of rectangular form having long sides 32 and short sides 33 with rounded corners 34, 35, 36 and 37 to mate with the corners 38, 39, 41 and 42 respectively, of funnel 25. Its rimless nature enables it to be made of a glass blank of essentially uniform thickness with an image viewing region 40 over an internal area, a perimeter region 40a including the area to be sealed to funnel 25 and the area shaded from the electron gun beams by the mask mounting structure. Mask-faceplate indexing elements on the face panel can be in the perimeter region 40*a* without interfering with the image viewing region 40.

Color and image fidelity in a color television picture tube is dependent upon the surface characteristics of the tube face panel. Ideally, a true spherical surface should be provided. Practically, such surfaces have been unobtainable in commercial quantities at acceptable cost. Pressed faceplates tend to have a wavy surface and tend to have dimples distributed over the surface to produce an effect termed "golf balling" for the resemblance to the surface of a golf ball. The present faceplate has no rim upstanding from its concave spherical surface in its perimeter region 40*a*. Accordingly, a truer spherical surface can be achieved as by precision sagging of sheet or plate glass panels or by pressing spherical surface panels and lap grinding the interior of those pressed panels to a spherical form. In each such process the wavy and golf ball surfaces are avoided.

In past constructions the positional relationship between the face panel and the mask has been established by mounting the mask on the rim of the face panel. In the arrangement of this invention the panel is mounted on the mask. Such mounting is adapted for the repetitive assembly and disassembly of a mask and panel during the forming of the multicolor phosphor mosaic with precision equal to or exceeding that of the past constructions. At least two and advantageously three indexing positions coupling the panel 21 to the mask 22 are provided. They are arranged to accommodate the slight dimensional variations of the elements while maintaining a fixed relationship between the elements relative to the tube axis by providing interfitting indexing elements which have a range of relative motion along a respective radius from the point on intersection of the tube axis.

Slots 43, 44 and 45 in the inner face of panel 21 adjacent and extending into the inner margin of the seal edge 46 on respective corners 34, 35, and 36 afford one element of a indexing means 24 for those corners and the panel. Cooperating with those slots are index pins 47 on ears 48 of mask mounting brackets 23 to form the complementary elements of the indexing means 24 as shown in FIGS. 1 through 6 and 9 through 13. In the drawings, the radial latitude of the positions of the interfitting and complementary index means 24 is shown provided along diagonals of the face panel as the lines A-O-B and C-O-D of FIG. 6 where O is the nominal center of the panel at the intersection of the tube and ultimate electron gun axis with the panel inner face when assembled in the tube. However, it is to be appreciated that a unique positional relationship can be established where the element affording positional latitude radially in on the bracket and the fixed element is on the panel or where the indexing means on both elements offer a degree of radial positional latitude as will be discussed with respect to the embodiments of FIGS. 14 through 17. Also, the radial positional latitude between elements of the indexing means 24 on the panel 21 and mask 22 need not extend along diagonals of the tube face. Such radial latitude can be from at least three spaced positions along sides 32 and/or 33.

Figure 10:
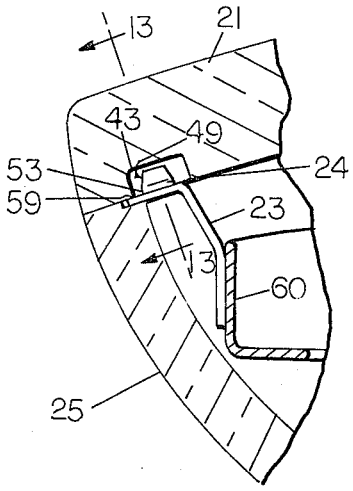
FIG. 10 is an enlarged fragmentary elevation taken along the line 10—10 of FIG. 1 showing the mask mounting bracket and its relationship to the funnel and face panel after a seal has been effected at the seal edges.
Figure 11:
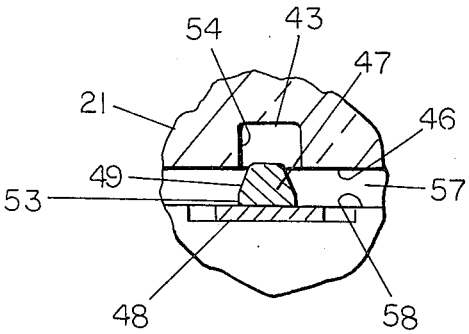
FIG. 11 through 13 are sections taken along the line 13—13 of FIG. 10 and showing the progressive seating and alignment of the face panel on the mask mounting bracket index pins as the glass frit seal is formed and the panel settles against the fluid seal material.
Figure 12:
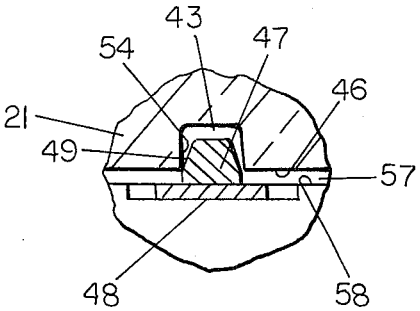
Figure 13:
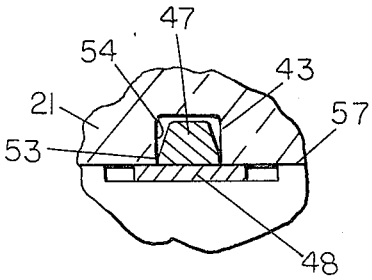

While radial latitude of the relative positions of pins 47 in their respective slots 43, 44 and 45 is provided, they are closely constrained transverse of the radius to define the desired unique relative position of panel to mask. This is accomplished by forming the width of the slots to closely fit the diameter of the pins when those pins are fully seated in the slots as shown in FIGS. 10 and 13. For example, with pins 47 having right circular cylindrical base regions adjacent ears 48 centered on radii from the nominal center of the mask, which is also coincident with the tube and electron gun axis, the indexing is realized if the slots are formed with portions of their lengths adapted to register with the pins having the widths thereof centered on radii from the nominal center of the faceplate. Panel-mask self alignment is realized by employing a tapered and camming interface portion providing a taper lead 49 on the mating elements of indexing means 24. Pine 47 have their axes in planes defined by the radius on which the slots with which they cooperate are formed and by the tube axis and they have a right-circular-cylindrical seating portion 53 for ultimate engagement with the slot sidewalls 54 spaced only slightly greater than the diameter of portion 53 and parallel to those respective defining planes. The camming action to the position of ultimate engagement is provided by frustoconical cap portions 49 on pins 47 as they engage the edges of the slots. As shown in FIGS. 11 and 12, slight misalignments of panel 21 relative to mask 22 are corrected as camming face 49 is carried across the edge of slot 43 during advancement of panel 21 toward ear 48 of the mask mounting bracket 23. This camming action is significant in the repetitive mounting of the panel on masks for forming the multicolor phosphor mosaic and in the final assembly where a bead 57 of solder glass frit for sealing is laid between the seal edge 46 of the panel and seal edge 58 of the funnel.

FIGS. 11, 12 and 13 show the progressive seating and alignment of the panel of the mask during the sealing of the panel of the funnel. Frit bead 57 as initially laid down spaces the panel from the funnel. During the heating of the elements to effect the seal, force, typically gravity where the panel is uppermost, tends to bring the panel seal edge 46 against the funnel seal edge 58 as the frit softens and, in effecting a bond, flows over the edges and from between them. Panel 21 settles toward funnel 25 and pin 47 cams the panel into alignment as it rides over the edge of slot 43 until in the seated position the cylindrical walls 53 of each pin are tightly embraced by side walls 54 of respective slots 43, 44 and 45.

Axial spacing and surface orientation of the mask and panel in the assembled tube are established by precisely positioned seats 59, 61, 62 and 63 along the seal edge 58 of funnel 25 as shown in FIGS. 2, 7 and 10 through 13. These seats receive ears 48 and thereby establish the position of brackets 23 generally so that the surface of the ears 48 proximate the panel are flush with the seal edge 58 of the funnel and form a portion of the seat receiving that panel.

Circumferential orientation of the mask-panel subassembly is realized by brackets 28 comprising an angularly fixed and radially free set of indexing pins 64 mounted on the mask by means of spring arms 29 secured to mask frame 60 and adapted to fit into slots 65 in the inner walls of funnel 25 adjacent seal edge 58. Advantageously, these slots 65 are formed in the funnel forming process at least three appropriately spaced positions around the funnel as the opposed short wall portions 66 and 67 and the long wall portion 68. The slots on opposite short sides of the funnel are aligned so that the radial biasing force of spring arms 29 are balanced. The third slot is triangularly related to the opposed slots to provide a stable mounting around the line of balanced opposed bias forces.

Figure 18:
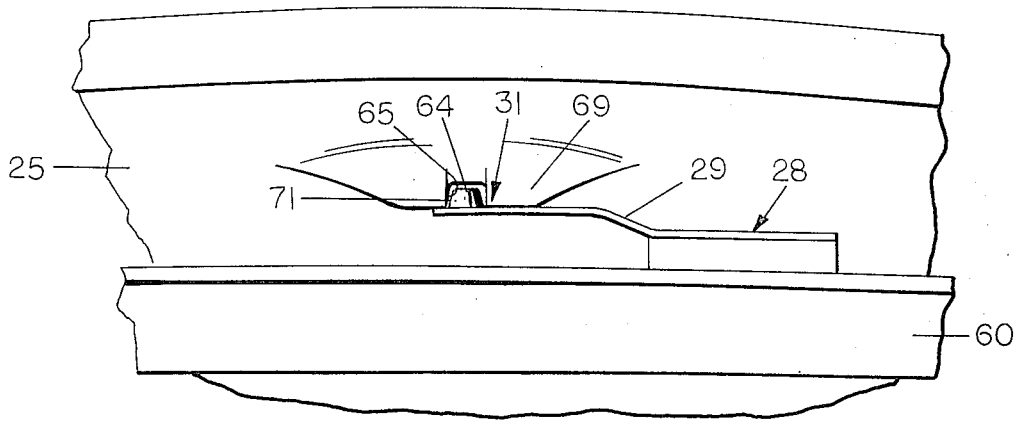
FIG. 18 is an enlarged fragmentary plan view of the positioning elements which facilitate transverse and circumferential positioning of the mask within the funnel.
Figure 19:
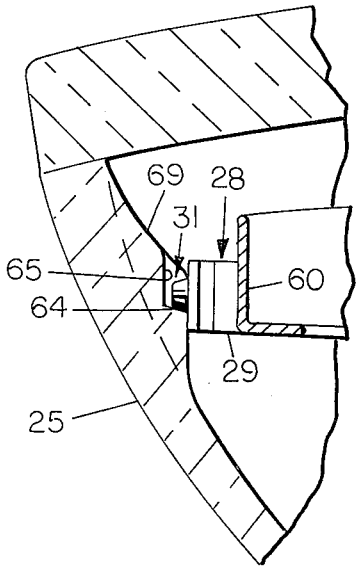
FIG. 19 is a side view of the fragmentary view of FIG. 18.

In some instances, it may be desirable in the interest of increased precision to grind the slots 65. The ground side walls can provide circumferential precision by cooperating with precisely located pins 64. Transverse precision of mask position in the funnel is enhanced by grinding the bottom of the slots to a predetermined depth and thus a predetermined spacing of transverse indexing means. Some advantage is realized, particularly in the convenience of mounting the mask in the funnel, if the slots 65 are located in bosses 69 protruding from the inner walls 66, 67 and 68. As in the case of panel indexing pins 47, a cam action can be achieved with pins 64 and slots 65, as shown in FIGS. 18 and 19, by providing a taper on the pins as a frustoconical surface 71 for engagement with the slot walls.

While the ends of pins 64 can be abutted against the bottom of slots 65 to provide the indexing of the transverse mask portion, it is advantageous to make the slots 65 of greater depth than the height of the pins 64 and to abut the face of the spring arms 29 adjacent the pins against the face of bosses 69. The boss faces can be formed in the forming of the funnel with a high degree of precision to provide the mask transverse indexing means. However, where even greater precision is required in mask position in the funnel it is convenient to grind their faces which will be abutted by the portions of spring arms 29 adjacent pins 64.

In order to accommodate circumferential orientation of the angularly rigid mask mounting brackets 23, their seats 59, 61, 62 and 63 are of greater lateral extent than ears 48 to afford some radial latitude in their position by the space 72 afforded outward of their ends and some circumferential latitude of position by the space 73 adjacent their sides. Thus at the mask is mounted into the funnel, its circumferential index pins 64 are displaced inwardly by flexing of spring arms 29 toward the rigid mask frame 60 as pins 64 are registered with slots 65. Further displacement of the mask toward the gun assembly mounting position 26 brings the undersurface of ears 48 on mask mounting brackets 23 to a seated relationship with seats 59, 61, 62 and 63 to establish the mask position in the funnel. The panel is then placed on the open end of the funnel in general registry with the mask so that pins 47 engage slots 43, 44 and 45 to cam it into final registry.

It is desirable to form the various glass indexing elements during the formation of the panel and funnel. However, in some instances those indexing elements may not be formed with sufficient precision, accordingly, they may be machined either in their entirety or as a final trimming for greater precision. If the panel is plate or sheet glass trimmed to size and sagged to the spherical contour, the mask referencing slots can be machined with diamond end mills or with ultrasonic grinding equipment. In pressed panels the slots can be formed during pressing and, if necessary, finally machined to the precise width and length centered on the radius from the panel center and the tube axis O. The funnel is formed with a scalloped spherical seal edge, mask bracket seats, and mask pin slots. Where forming accuracy is to be improved upon, the seal edge is made slightly oversized to minimize later edge grinding.

In order that all critical reference surfaces are related to the tube axis, the funnel 25 is chucked for application of the neck 27 centered on the axis with minimum tilt by conventional techniques. Thereafter, machining of the funnel-neck subassembly can be referenced to the interior of the neck as defining the ultimate electron gun assembly axis and the coincident tube axis. The funnel seal edge 58 can be spherically ground employing the tube axis at the gun assembly mounting position 26 as the reference center and thereby conforming to the panel seal edge 46 since the spherical contour of the faceplate is based on a similar center and radius. Seats 59, 61, 62 and 63 can be ground employing the gun assembly mounting position 26 as the reference center as can be the grooves or slots 65 and the faces of bosses 69 to be employed in orienting and centering the mask frame in the funnel in relation to the axis of the subassembly neck 27.

In the above manner, the funnel-neck subassembly provides reference surfaces by establishing the neck axis coincident with the funnel axis internally at those levels at which the gun assembly will be centered later in the fabrication. This established axis and center are then employed as references for grinding seal edges, mounting bracket seats, mask frame centering boss seats, and circumferential orientation slots. Since the electron gun assembly is installed with reference to the neck tube and thus to the same reference with which the funnel-neck subassembly was positioned to grind the bosses and/or circumferential centering grooves, the projection of the gun center-line has minimum eccentricity in relation to the mask and panel.

Figure 14:
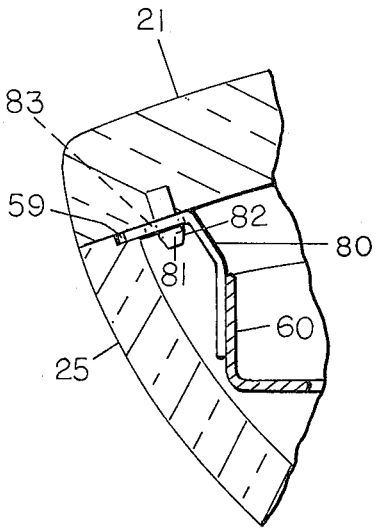
FIGS. 14 through 17 are other forms of means of indexing a rimless face panel on a mask assembly showing a fragment of the face panel. funnel and mask bracket with the views taken as in FIG. 10.

The positioning of the face with respect to the mask by supporting if from the mask lends itself to variations of indexing means, as shown in FIGS. 14 through 17. While precision cavities in the faceplate are considered least expensive to produce, it is to be appreciated that bosses can be formed on the faceplate or studs mounted thereon as indexing elements. The mask mounting brackets can be provided with receptacles as indexing elements cooperating with the faceplate indexing elements. In FIG. 14 there is shown a stud 81 mounted in face panel 21 having a lead taper 82 for camming the panel to final position as it enters a slot 83 in bracket 80 having its major axis center line extend radially from the center of the mask of the ultimate product, the tube axis. The slot width closely fits the base of the stud 81 and the length of the stud is sufficient to permit the lead taper 82 of each pin to be inside its respective slot 83 when the solder glass bed 57 of the seal is thick, as at the initial assembly of the two parts. As the solder glass begins to flow in the sealing cycle, the panel will settle against the mask bracket ear and the straight section of the pin will enter and be closely confined by the slot walls to again seek the unique centering and rotational relationship it originally had with the mask during light-housing.

Figure 15:
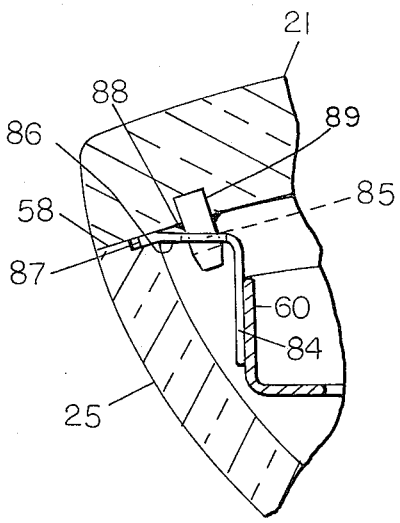

FIG. 15 shows a bracket 84 with a slotted length 85 subtending an obtuse angle 86 with ear 87 to avoid interference with the fairing of glass 88 around stud 89. Again the slot 85 is radial and the ear is set flush with sealing edge 58 of funnel 25.

Figure 16:
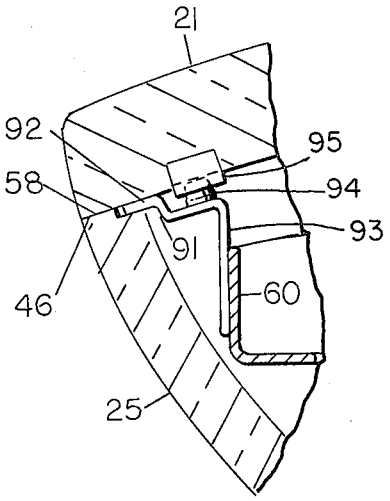

FIG. 16 utilizes a leg 91 offset from the general plane of mounting ear 92 of the mask mounting bracket 93 to enable a protuberance 94 on the leg 91 to mate with spaced protuberances 95 on the inner face of face panel 21. The interfitting protuberances are of sufficient height to guide the panel into proper registry during sealing and the depth of the offset is sufficient to permit seating of the seal edge 46 on seal edge 58. Relative motion along a radius to the tube axis is afforded by the alignment of the protuberances 95. The panel protuberances can be glass formed with the panel, a metal insert of sheet spring metal having ears upset from its surface, or the sides of slotted stud.

Figure 17:
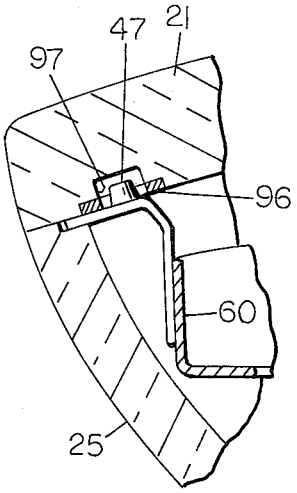

A metal disc insert 96 having an underlying cavity 97 in the face panel 21 and a radial slot aligned with the cavity for reception of index pin 47 is shown in FIG. 17.

Figure 20:
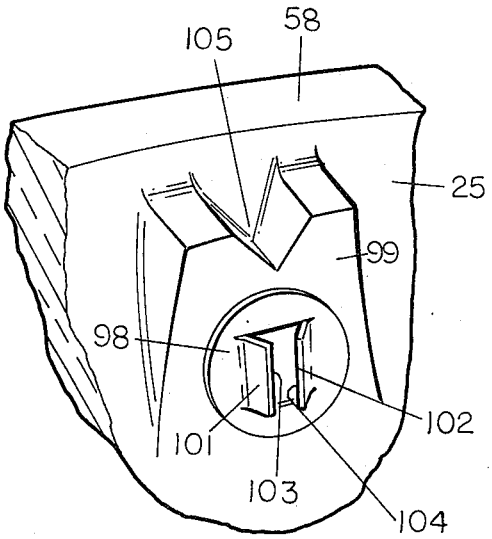
FIG. 20 is an enlarged fragmentary perspective view taken as in FIG. 18 to show another means of circumferentially indexing the mask-panel subassembly in the funnel.

Alternative forms of circumferential indexing means employing interfitting protuberances and cavities of the same general form as the mark-panel indexing means of FIGS. 14–17 can be utilized. One typical indexing means is the metal disc insert 98 of FIG. 20 mounted on boss 99 and provided with upstanding ears 101 and 102 having parallel edges 103 and 104 lying in planes extending radially from the tube axis. The margins of the plate beyond the ears can provide index regions for transverse orientation of abutments on the ends of spring arms 29. Orienting groove 105 in boss 99 can be employed in mounting the disc insert 98.

Formation of the phosphor mosaic on the image viewing area 40 is accomplished with greater convenience than heretofore since the faceplate 21 is merely placed on the mask mounting brackets 23 with each index pin 47 in registry with its indexing slot 43, 44 or 45. The taper leads 49 guide the faceplate into its unique positional relationship with the mask as they are advanced into slots 43, 44 and 45 to bring the abutting flanges or ear surfaces of ears 48 into contact with the inner face of the faceplate adjacent the slots. Thus the repetitive mounting and dismounting of the faceplate 21 on the mask is accomplished during the repetitive cycles of phosphor application, photographic exposure, and removal of excess phosphors without the need to overcome bias spring forces or to fit the mask into a surrounding rim.

Assembly of the mask 22 with the funnel 25 with the proper orientation establishes the position of the faceplate 21 on the funnel 25. The axial position of the spherically contoured mask is established with the precision of the location of seats 59, 61, 62 and 63 on funnel 25 and the precision of mask mounting brackets 23 with respect to the rigid mask frame 60 since the ears 48 have their surfaces opposite the faceplate indexing pins 47 mounted in the abutting relation to the seats and are sealed in that relation. Transverse orientation of the mask to establish its nominal center on the axis of the tube is assured by the biasing means, spring arms 29, which imposes radially inwardly directed forces on rigid mask frame 60 by bearing upon the indexing surfaces, bosses 69, on the inner surface of the funnel 25. Circumferential orientation of the mask around the tube axis is established by the indexing means on spring arms 29 and bosses 69, the pins or studs 64 and slots 65. Thus only one mounting of the frame 60 within surrounding walls is required in the fabrication to establish its orientation in all three dimensions by abutments against glass reference surfaces which can be formed or ground.

Since the system of engagement of three pins on the mask frame into matching radial grooves in the inside faceplate surface assures that any mask will repeatedly assume one unique position relative to any given faceplate, the relationships employed in the lighthouse for mosaic formation can be repeated in the funnel during sealing of the faceplate to the funnel. Thus the inside surface of the faceplate and the mask contour have the same spacing from the lighthouse as the electron gun assembly position since both are established by abutting surfaces which can be precisely located. This virtually eliminates the adverse effects of variations in tube axial lengths.

The faceplate of funnel positioning and seal is accomplished by laying a bead 57 of solder glass frit on one of seal edges 46 and 58 with the respective faceplate and mask indexing means in at least near registry and engaged. The lead toner 49 to the right-circular-cylindrical base of index pins 47 will cam the wall edges of slots 43, 44 and 45 as the bead 57 flows during the seal heating cycle. When the faceplate is uppermost so that gravity biases it to seat on brackets and aligned seal edge 58 of funnel 25, it seeks its formerly established unique positional relationship to the mask as the solder glass frit softens and flows to permit the setting of the faceplate on ears 48 and seal edge 58 flush with those ears. No frit seal jig is required in the faceplate to funnel assembly with this process.

It is to be appreciated that the structure and method of fabrication of television picture tube faceplate-shadow mask-funnel assemblies by mounting the faceplate on the mask lends itself to structures other than those illustrated. For example, the faceplate contour and outline and conforming mask contour and outline might be other than spherical and rectangular. Alternative reference positions for establishing indexing surfaces in the funnel might be established in place of the interior of the funnel neck at the electron gun assembly position. The form of the frame assembly including its mounting brackets can be altered without loss of the unitary functions of precise positioning within the funnel and mounting and positioning the faceplate on the funnel. It is within the concept of this invention to utilize a mask mounted on the inner face of a faceplate which has rim portions. In such an arrangement the advantages of a faceplate with uniform thickness to its edges can be traded for the complex funnel edge geometry as by forming rims portions which are defined by the perimeter arcs of the faceplate sides and chords extending between the corners of the faceplate to produce a seal edge on the faceplate which falls in a plane and can be mated with a planar rim and seal edge on the funnel.

In view of the variations in the elements and combinations of this invention as disclosed, it is to be appreciated that the preceding description is to be read as illustrative and not in a limiting sense.

What we claim is:

1. A faceplate for a color television picture tube comprising a glass plate of essentially uniform thickness over a major surface including an image viewing region and having at least two spaced cavities in the major surface thereof which is adapted to be mounted proximate an electron gun mounting for said tube, said faceplate being in combination with: a shadow mask color-selection device having a major surface contour matching the major surface of said plate; a plurality of mounting brackets having portions extending in a direction having a component normal to the major surface of said mask; index protuberances secured to said mounting brackets fitting into said two spaced cavities in said faceplate to maintain said proximate faceplate major surface and said mask major surface uniformly spaced.

2. A faceplate combined with a shadow mask according to claim 1 wherein said cavities are in the major surface of said faceplate adjacent said mask and including abutments on said brackets abutting the surface of said faceplate adjacent said cavities; and said protuberances are studs on said brackets fitting into said cavities.

3. A faceplate combined with a shadow mask according to claim 1 wherein said faceplate is of generally spherical surface contour.

4. A faceplate combined with a shadow mask according to claim 3 wherein said faceplate has a third cavity in said proximate major surface spaced from a line between said first mentioned two cavities and said mask has a bracket having an index protuberance registering with and fitting in said third cavity when said first mentioned protuberances fit within said two spaced cavities and wherein said faceplate and said mask are of generally rectangular outline in their major surfaces.

5. A faceplate combined with a shadow mask according to claim 4 wherein said indexing means are in corner regions of said faceplate and shadow mask.

6. A faceplate combined with a shadow mask according to claim 5 including a fourth bracket in a corner region of said shadow mask spaced from said bracket having index means and having a surface abutting a corner region of said faceplate.

7. A faceplate and shadow mask according to claim 1 wherein said faceplate has an image viewing region and a perimeter region outside said viewing region and wherein said indexing means are located outside of said viewing region.

8. A faceplate and shadow mask according to claim 7 in combination with:

a funnel having a seal edge generally comforming to the surface contour of said perimeter region of said faceplate;

said seal edge of said funnel having cavities to accommodate a portion of each of said brackets;

and a seal between said funnel and said faceplate securing a portion of each of said brackets.

9. A faceplate and shadow mask according to claim 7 in combination with:

a funnel having a seal edge generally conforming to the surface contour of said perimeter region of said faceplate;

a plurality of seats on the interior of said funnel in the vicinity of said seal edge; and means mounting said brackets on said seats to establish the depth of said mask in said funnel and to establish the position of said faceplate in sealing proximity to said seal edge.

10. A faceplate, shadow mask and funnel combination according to claim 9 wherein said brackets have a surface in abutting relationship to said seats; and a seal between said funnel and said faceplate securing a portion of each of said brackets to a respective one of said seats.

11. A faceplate, shadow mask and funnel combination according to claim 9 wherein said brackets have ears extending outward of said mask; said ears have a first surface abutting said faceplate and a second surface spaced by a thickness of said ears from said first surface abutting said respective seat; said respective seats each being located in said funnel seal edge a depth below said seal edge corresponding to said thickness of said respective ear.

12. A faceplate, shadow mask and funnel combination according to claim 9 including a rigid frame for said mask and at least three biasing means between said frame and said funnel inner walls, triangularly spaced around said mask adjacent said seal edge, biasing said frame radially inward.

13. A faceplate, shadow mask and funnel combination according to claim 12 including indexing means on the inner surface of said funnel walls adjacent said seal edge and wherein said biasing means engage said indexing means.

14. A faceplate, shadow mask and funnel combination according to claim 13 wherein said indexing means have lateral constraining means engaged with said biasing means and said biasing means are angularly fixed on said frame to establish a transverse orientation of said frame in said funnel.

15. A faceplate, shadow mask and funnel combination according to claim 12 wherein two of said biasing means are in aligned opposition on opposite sides of said frame.

16. A faceplate, shadow mask and funnel combination according to claim 13 including at least three bosses on the said funnel inner walls, said bosses each being in radial alignment with a respective biasing means to provide said indexing means.

17. A faceplate for a color television picture tube comprising a glass plate of essentially uniform thickness over a major surface including an image viewing region and having at least two spaced cavities in the major surface thereof which is adapted to be mounted proximate an electron gun mounting for said tube, said faceplate being combined with a shadow mask and; indexing protuberances secured to said mask and fitting into said two spaced cavities in said faceplate to maintain said proximate faceplate major surface and said mask spaced.

18. A faceplate combined with a shadow mask according to claim 17 wherein said mask has a major surface contour matching the major surface of said plate, wherein said faceplate and said mask have nominal centers for their major surfaces adapted to be located on the axis of an electron gun assembly of said tube and wherein said cavities have a length and a uniform width over a substantial portion of said length and their longitudinal axes which are centered along said uniform width lie in a plane extending radially from a line joining said mask and faceplate nominal centers.

19. A faceplate combined with a shadow mask according to claim 18 wherein said cavities are in the major surface of said faceplate adjacent said mask and including abutments on said brackets having an abutting surface abutting the surface of said faceplate adjacent said cavities; and studs on said abutting surface of said brackets having a width normal to and centered on respective ones of said radial planes only slightly less than the width of said respective slots and fitting into said respective slots.

20. A faceplate combined with a shadow mask according to claim 19 wherein said studs have a lead taper at their distal end.

21. A color television picture tube comprising:

a rimless faceplate of generally spherical surface contour and generally rectangular outline;

a glass funnel having a divergent wall terminating at its divergent end in a seal edge for mating with said faceplate which is of generally rectangular outline and is scalloped to a spherical contour matching said faceplate contour;

a shadow mask color-selection device;

a rigid generally rectangular frame for said shadow mask fitting within said glass funnel adjacent said seal edge;

at least three spaced mounting brackets extending from at least two sides of said frame toward said faceplate;

an ear on each of said mounting brackets extending outward of said frame to overlie said seal edge and having a thickness;

said seal edge having a depression receiving each of said ears and of a depth equal to the thickness thereof whereby the surfaces of said ears adjacent said faceplate are flush with said seal edge;

a stud upstanding from the surface of each of at least three of said ears which is adjacent said faceplate; and a cavity in said faceplate in registry with and receiving each of said studs.

22. A color television picture tube according to claim 21 including:

at least three studs extending outward from said frame;

means resiliently biasing said studs outward; and said funnel having cavities on the inner face of its divergent wall adjacent said seal edge and receiving said studs.

23. A color television picture tube according to claim 22 including a flange around each of said studs which extend outward from said frame; and said funnel having reference surfaces on the inner face of its divergent wall adjacent said cavities against which said flanges are resiliently biased.

24. A color television picture tube subassembly comprising a faceplate having an image viewing region and a perimeter region contiguous to the viewing region and in the general contour of the viewing region; a shadow mask color-section device adapted to be maintained in a unique positional relationship with said faceplate; said faceplate having cavities forming first indexing elements on the face of said faceplate proximate said mask in the perimeter region of the faceplate; and second indexing elements secured to said mask and adapted to cooperate with said first indexing elements to establish said unique positional relationship.

* * * * *

Notice of Adverse Decision in Interference

In Interference No. 99,612, involving Patent No. 3,997,811, E. M. Tom and R. L. Vogelpohl, COLOR TELEVISION TUBE STRUCTURE AND METHOD OF MANUFACTURE, final judgment adverse to the patentees was rendered Nov. 4, 1977, as to claims 1, 3, 4, 5, 6, 7, 17, 18 and 24.

[*Official Gazette February 14, 1978.*]